US009649676B2

(12) United States Patent
Zuser et al.

(10) Patent No.: US 9,649,676 B2
(45) **Date of Patent: *May 16, 2017**

(54) METHOD FOR PRODUCING AN ALUMINIUM FOIL WITH INTEGRATED SECURITY FEATURES

(71) Applicant: CONSTANTIA TEICH GMBH, Weinburg (DE)

(72) Inventors: Wilhelm Zuser, Hofstetten (AT); Adolf Schedl, Lilienfeld (AT); Engelbert Scharner, Kilb (AT); Lambert Nekula, Hofstetten (AT); Martin Kornfeld, Klosterneuburg (AT); Rainer Huber, St. Polten (AT); Christof Brunnthaler, Amstetten (AT)

(73) Assignee: CONSTANTIA TEICH GMBH, Weinburg (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/439,367

(22) PCT Filed: Oct. 8, 2013

(86) PCT No.: PCT/AT2013/000164
§ 371 (c)(1),
(2) Date: Apr. 29, 2015

(87) PCT Pub. No.: WO2014/066918
PCT Pub. Date: May 8, 2014

(65) Prior Publication Data

US 2015/0273547 A1 Oct. 1, 2015

(30) Foreign Application Priority Data

Oct. 29, 2012 (AT) ..... A 1163/2012

(51) Int. Cl.
*B21B 1/22* (2006.01)
*B21B 1/40* (2006.01)
(Continued)

(52) U.S. Cl.
CPC ..... *B21B 1/40* (2013.01); *B21B 1/227* (2013.01); *B21B 27/005* (2013.01); *B21B 27/10* (2013.01);
(Continued)

(58) Field of Classification Search
CPC .. B21B 1/22; B21B 1/227; B21B 1/40; B21B 27/00; B21B 27/005; B21H 8/00;
(Continued)

(56) References Cited

U.S. PATENT DOCUMENTS 5,025,547 A 6/1991 Sheu et al.
6,187,455 B1 2/2001 Eschauzier
(Continued)

FOREIGN PATENT DOCUMENTS

DE 69108284 T2 10/1995
EA 200801017 A2 10/2008
(Continued)

OTHER PUBLICATIONS

Russian Search report, dated Aug. 1, 2016, from corresponding Russian Patent Application No. 2015120279.
(Continued)

*Primary Examiner* — Bruce H Hess
(74) *Attorney, Agent, or Firm* — Young & Thompson

(57) ABSTRACT

Method for producing an aluminum foil with integrated security features. An aluminum foil is rolled down to a thickness of less than 150 μm in a plurality of cold rolling passes, texturing that runs in the direction of rolling being induced simultaneously on both surface sides of the foil. In a final cold rolling pass, the foil is fed to a working roller
(Continued)

Figure 1:
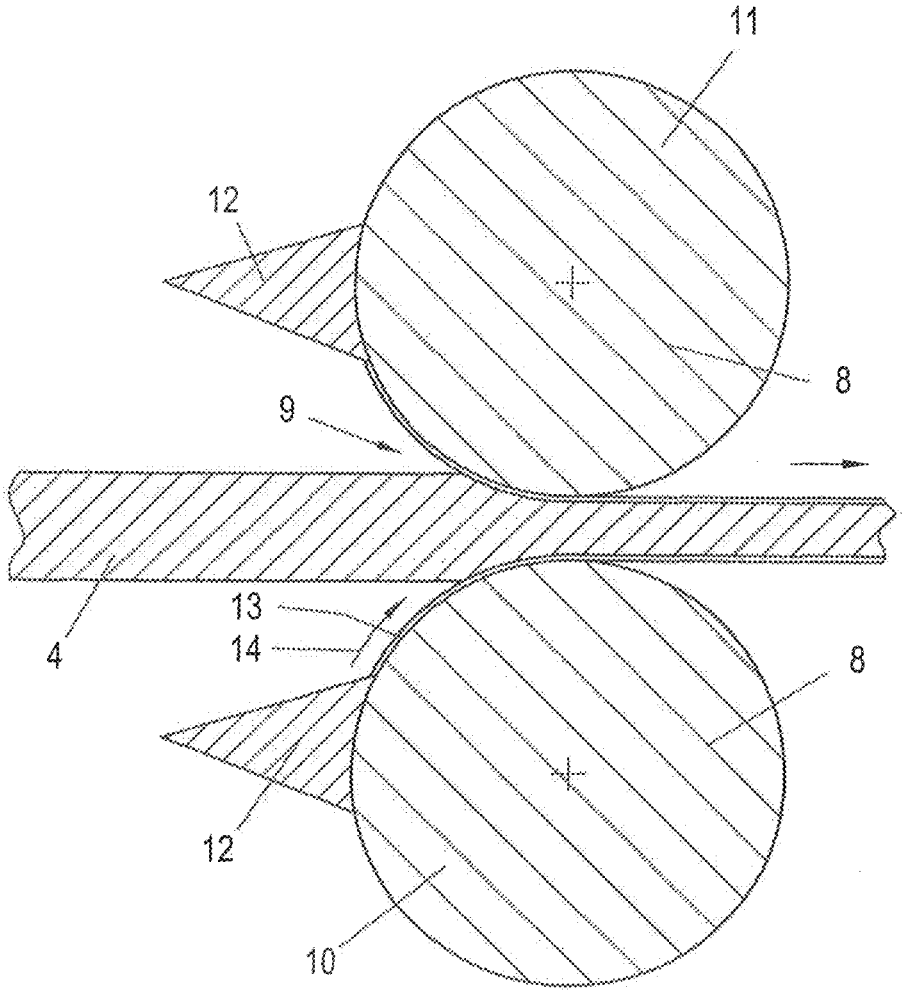

pair, in which, on at least one roller surface, the relief-like surface structuring generated in the rolling direction by grinding was reduced on the basis of contrast and motif in a region of 10 to 50% relative to the average surface roughness to form a motif for a security feature that is transferred to the surface side of the foil facing the roller surface. The generated aluminum foil has a glossy appearance on both sides such that the security feature rises clearly due to its dull appearance.

5 Claims, 12 Drawing Sheets

(51) Int. Cl.

| | |
|---|---|
| ***B21B 27/00*** | (2006.01) |
| ***B21H 8/00*** | (2006.01) |
| ***B42D 25/324*** | (2014.01) |
| ***B42D 25/425*** | (2014.01) |
| ***B44C 1/24*** | (2006.01) |
| ***B21B 27/10*** | (2006.01) |
| *B21B 3/00* | (2006.01) |

(52) U.S. Cl.
CPC ..... *B42D 25/324* (2014.10); *B42D 25/425* (2014.10); *B44C 1/24* (2013.01); *B21B 2003/001* (2013.01); *Y10T 428/12993* (2015.01); *Y10T 428/24479* (2015.01)

(58) Field of Classification Search
CPC .... B21H 8/005; B42D 25/324; B42D 25/425; B44C 1/24; Y10T 428/1299; Y10T 428/24479
USPC ..... 428/687, 156; 72/252.5, 256.6
See application file for complete search history.

(56) References Cited

U.S. PATENT DOCUMENTS

| | | | |
|---|---|---|---|
| 6,290,632 | B1 | 9/2001 | Blake et al. |
| 2014/0322557 | A1 | 10/2014 | Brunnthaler et al. |

FOREIGN PATENT DOCUMENTS

| | | | |
|---|---|---|---|
| EA | 011838 | B1 | 6/2009 |
| EP | 1344580 | A1 | 9/2003 |
| EP | 1767405 | A1 | 3/2007 |
| EP | 2 572 807 | A1 | 3/2013 |
| JP | 577303 | A | 1/1982 |
| WO | 03/104890 | A1 | 12/2003 |
| WO | 2007002963 | A1 | 1/2007 |

OTHER PUBLICATIONS

International Search Report, dated Mar. 14, 2014, from corresponding PCT application.
At Search Report, dated Apr. 23, 2013, from corresponding AT application.

| | | | |
|---|---|---|---|
| Arithmetic Mean of Surface Roughness Ra | $Ra_1$ | $Ra_1$ + - 10% | $Ra_1$ |
| Mean Depth of Surface Roughness Rz | $Rz_1$ | 0,7x $Rz_1$ + - 10% | $Rz_1$ |

METHOD FOR PRODUCING AN ALUMINIUM FOIL WITH INTEGRATED SECURITY FEATURES

BACKGROUND OF THE INVENTION

Field of the Invention

The invention relates to a process for the manufacture of an aluminum foil with integrated security features as well as to an aluminum foil with integrated security features manufactured by this process.

Description of the Related Art

Medical products, which are generally packaged with the help of aluminum foils are often a target for forgeries. Forgery-proof features should therefore be as close as possible to the medical product, which means the direct application of security features during the manufacturing process of primary packaging offers the best conditions herefor.

It was therefore attempted—as is common with banknotes—to provide packaging materials for the pharma industry with holograms. It was however discovered that even holograms, although their manufacture is relatively complex, can be forged.

This is where the invention is to provide a remedy.

SUMMARY OF THE INVENTION

In accordance with the invention, a process of the above-mentioned type is suggested, whereby an aluminum foil in several cold roll reduction passes is rolled down to a thickness of less than 150 μm and whereby at the same time a texturing extending in rolling direction is created on both faces of the aluminum foil, whereby the aluminum foil is guided in a final rolling pass to a working roller pair, in which on at least one roller surface the relief type surface structuring produced by grinding in rolling direction is reduced, depending on contrast and motif in the range of 10-50% relative to the average depth of surface roughness for the formation of a motif for a security feature which is transferred to the outer face of the aluminum foil facing the roller surface.

The invention further relates to an aluminum foil with integrated security features, which is manufactured according to the process of the invention and which has security features to an extent of at most 30% per unit of surface.

BRIEF DESCRIPTION OF THE DRAWING FIGURES

The invention is further described in the following by way of a possible exemplary embodiment for the realization of the invention as well as by way of FIGS. 1-8.

Figure 2A:
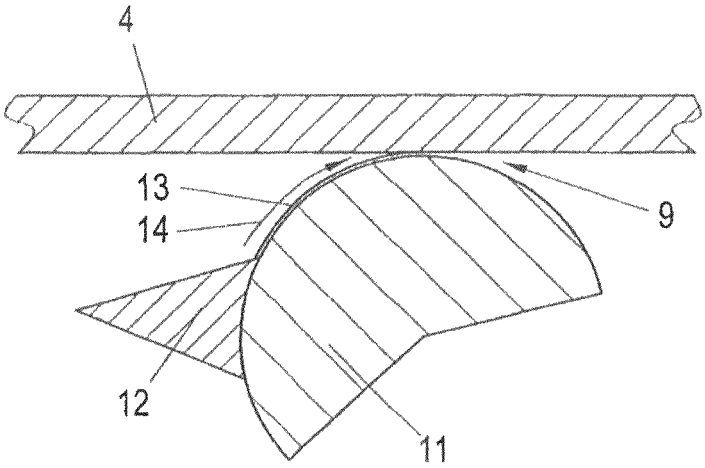
Figure 2B:
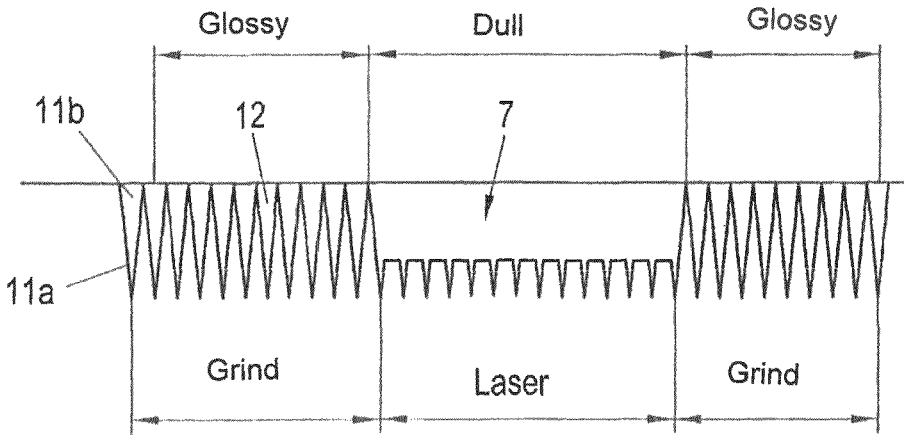
Figure 2C:
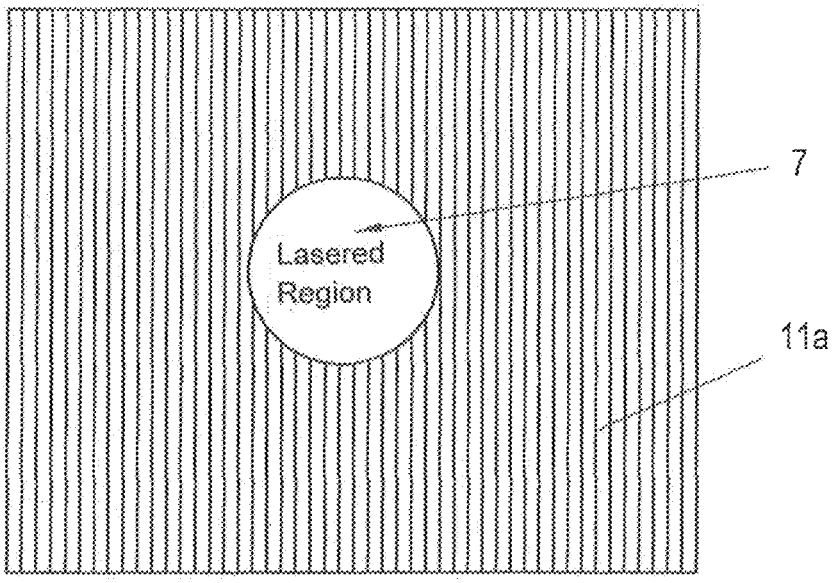
Figure 3:
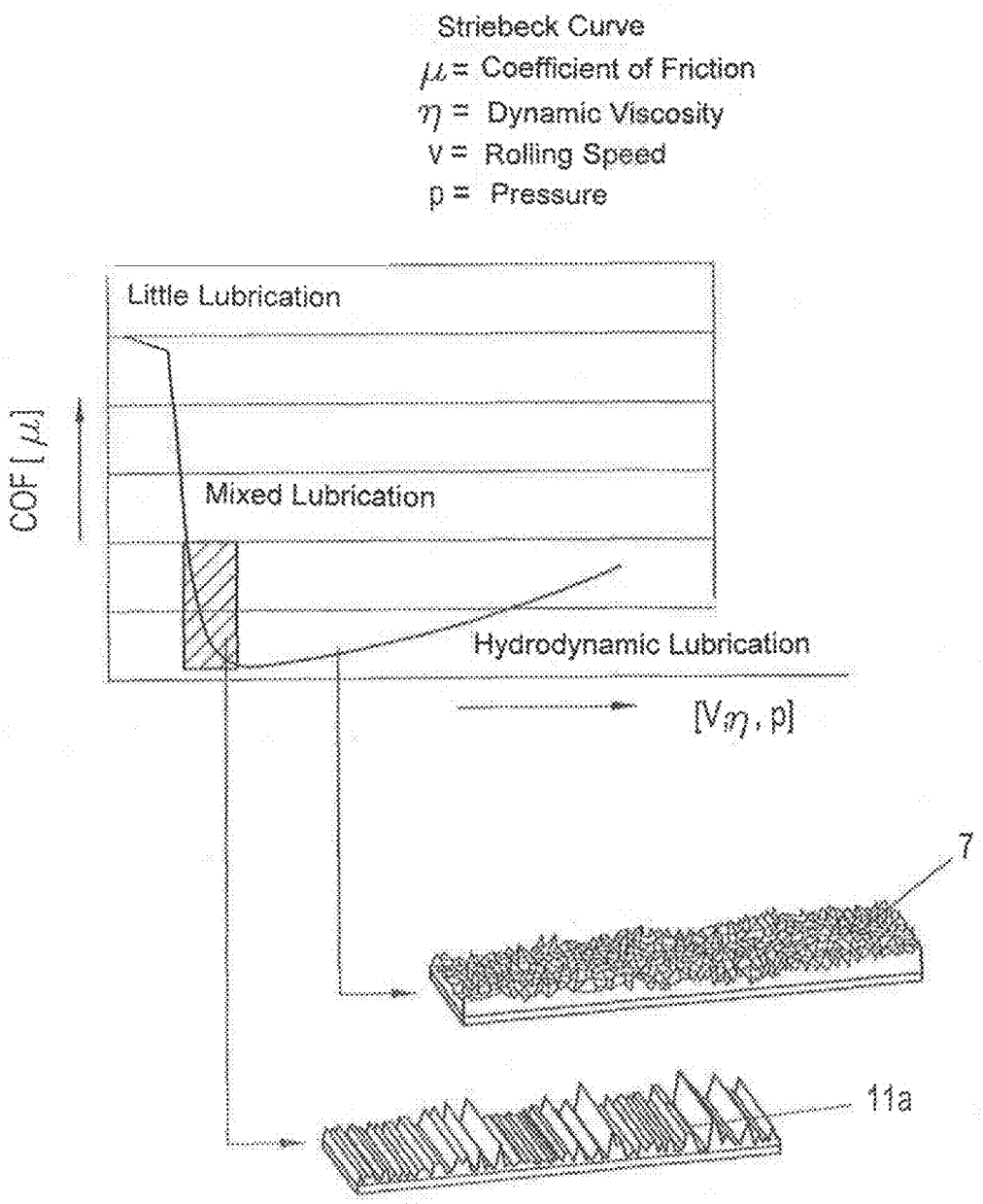

It is thereby shown in FIG. 1 a working roller pair for the execution of the process in accordance with the invention, in FIG. 2 a detailed view of one working roller as well as its surface design, in FIG. 3 the Striebeck curve for the documentation of the relevant process parameters in the roller gap and in FIG. 4 the process sequence of the process for the manufacture of the integrated security features.

FIGS. 5-8 show possible embodiments of the integrated security feature.

DETAILED DESCRIPTION OF THE INVENTION

The manufacturing process for the aluminum foil 1 in accordance with the invention with integrated security features 6 consists first of all of the sub-processes of strand casting, homogenization, hot rolling, cold rolling and subsequent annealing above the recrystallization temperature. This is followed by the foil cold rolling process. The aluminum foil 4 is thereby rolled down in several cold rolling passes to a thickness of less than 150 μm, whereby simultaneously on both outer faces 4*a*, 4*b* of the aluminum foil a texturing 5*a*, 5*b* is created in rolling direction, as shown in FIG. 4*b*. This structured surface roughness formed in rolling direction leads to a directed reflection of the incident light, so that because of this directed reflection the outer faces 4*a* and 4*b* have a glossy appearance.

Figure 4A:
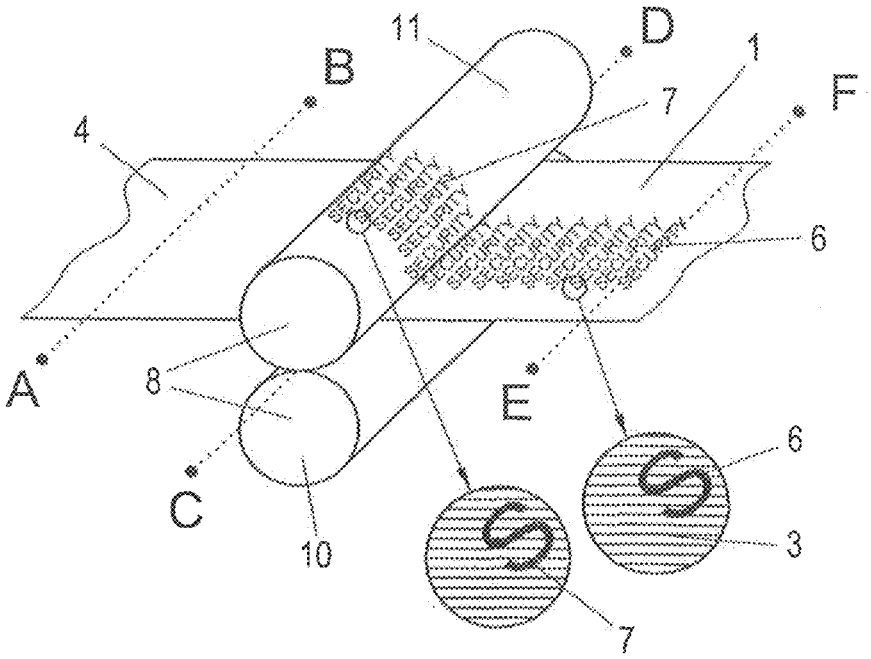
Figure 4B:
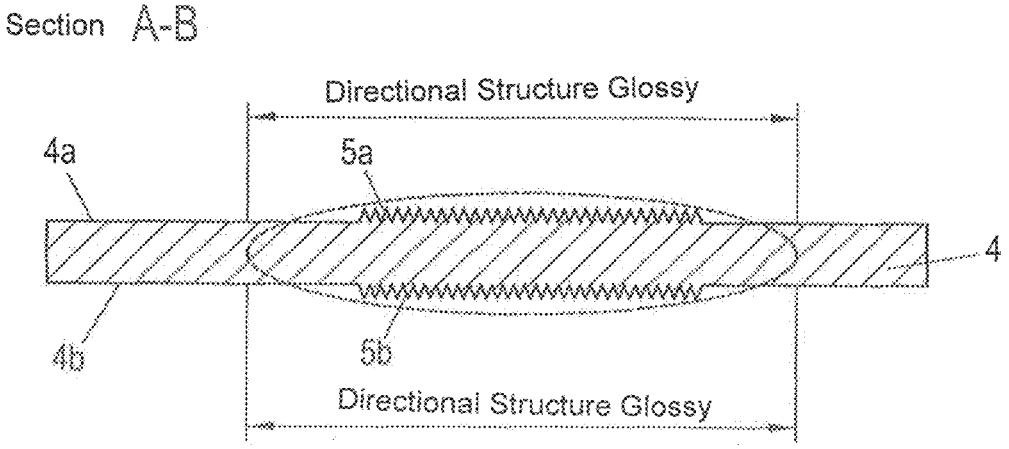
Figure 4C:
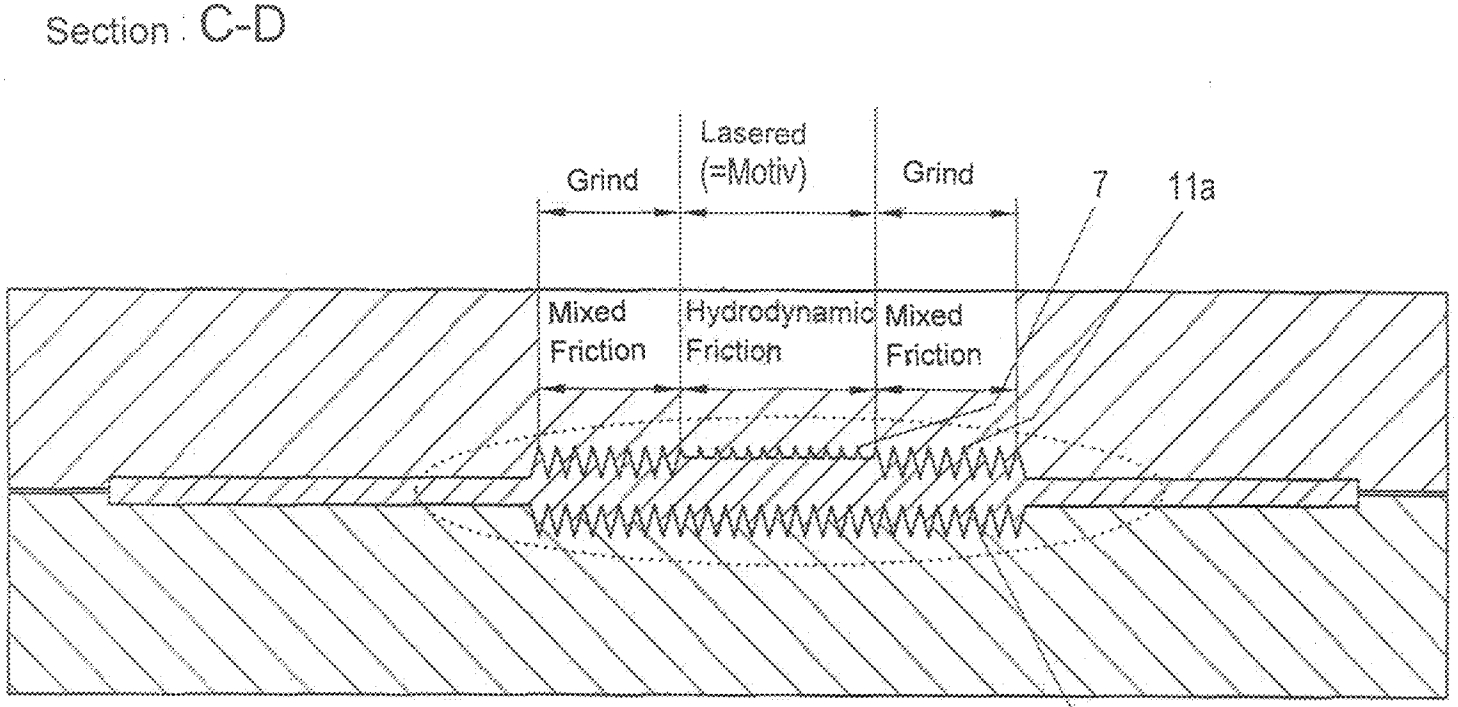
Figure 4D:
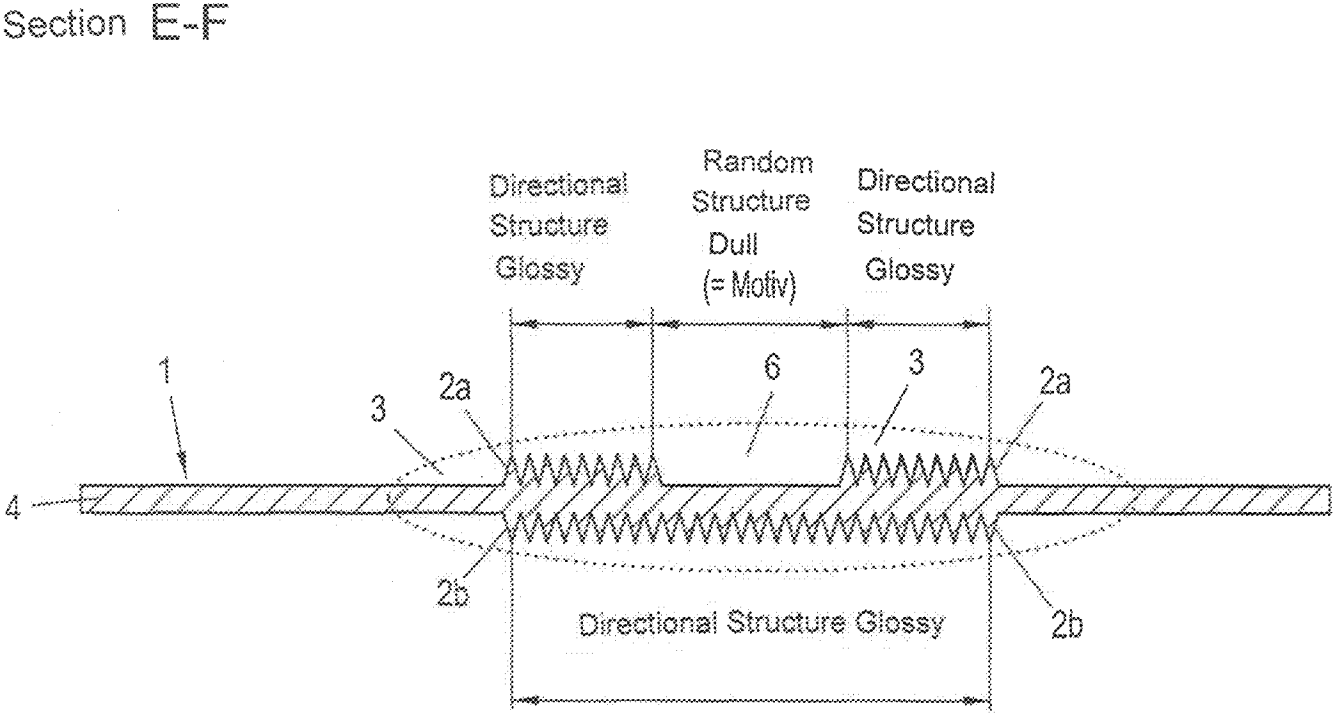
Figure 4E:
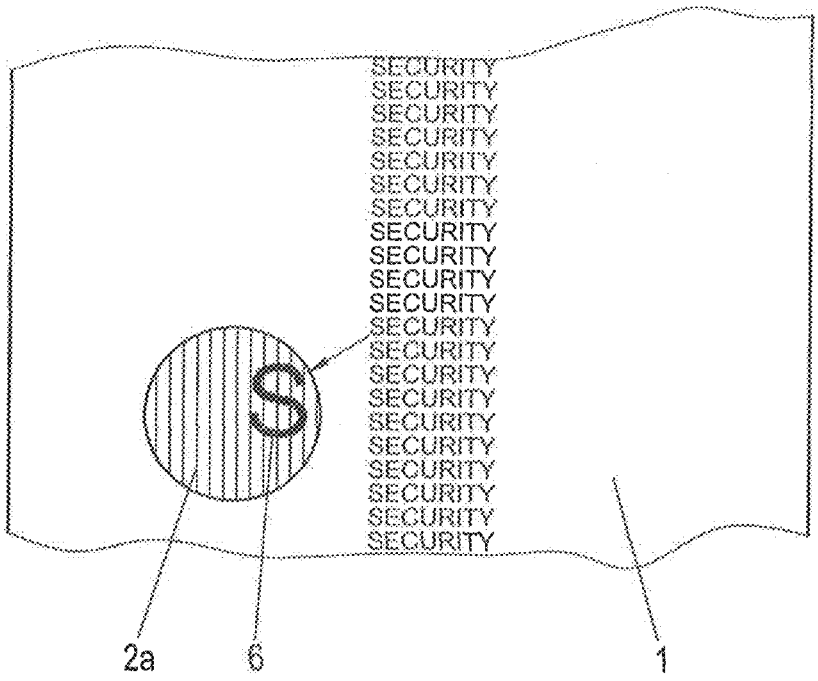

The process is modified for the last rolling pass as shown in FIG. 1 as well as FIG. 4*a*, whereby a working roller pair 9 is used in which at least one roller surface has a motif 7 for the security feature. This motif 7 is produced in that the relief-like surface structuring 11*a* which is produced in rolling direction by grinding, is reduced depending on the contrast and motif in the range of 10-50% relative to the average surface roughness depth. This can be carried out, for example, by the action of laser beams as shown in FIGS. 2*b*, 2*c* and 4*c*. For the last cold rolling step, the aluminum foil 4 is fed into the closed roller gap 9, which is formed between the two working rollers 10, 11. The motif for the security feature 6 is now transferred onto the outer surface 4*a* of the aluminum foil, which is directed towards the working roller. A random texturing which appears dull is now formed in the region of the security feature 6 of the aluminum foil 1—see FIG. 4*d*—which is visibly distinguished from the remaining outer surface region 2*a* having a glossy appearance and directed texturing 3. Because of this random texturing, a diffuse reflection of the incident light occurs in the region of the security feature 6, so that the region of the security feature 6 appears dull.

When both working rollers are provided with a motif 7, an integrated security feature 6 is produced on both outer surfaces 4*a* and 4*b* of the aluminum foil 4.

The foil rolling process underlying the process in accordance with the invention belongs to the subcategory "flat rolling" and is defined especially through process end products with a thickness of 20-160 μm. The cold rolling process in this thickness range requires the specific application of surface roughness values on the tools in combination with the procedural liquid which create the tribologic conditions in the roller gap required for the plastic deformation.

Reference is made to the Striebeck curve—see FIG. 3—for the documentation of the process parameters relevant for the procedure.

The co-efficient of friction is represented on the X axis and the function of speed, pressure and viscosity is represented on the Y axis. The mixed friction range is required for the cold rolling of foils. In a region of little lubrication, a continuous contact with the rolled material occurs; a reduction of the material in this region is not possible and leads in the following to poor surface properties and damage to the roller. In a region of hydrodynamic lubrication—see in this respect Reference no. 14 in FIG. 2*a*—the working roller 11 starts to float so that a directed control of the rolling process and especially of the reduction of the material thickness is no longer possible. The range of mixed friction can thereby be adjusted by varying the parameters v, p and n.

Only in the mixed friction range is it possible to generate longitudinal and pressure tensions which load up the material past the shape change resistance in order to thereby lead to a reshaping, which means reduction of the material thickness. The adjustment of the parameters of the rolling oil 12, which are required for the reshaping process, namely viscosity, pressure stability, lubricant effect, is carried out by the precise selection of a base oil, namely a kerosene-like, highly refined hydrocarbon with an exactly defined viscosity and by the addition of about 5%/volume rolling oil additives which on the one hand bring the pressure stability of the medium to a specific level but also significantly influence the friction conditions in the roller gap 9.

The coordination of these parameters represents the basic requirement for the process in accordance with the invention. These parameters are therefore permanently monitored and readjusted. In the concrete application, the concentration of the rolling oil additives is measured directly through sampling from the buffer container of the roller rack and maintained within an exactly defined range by way of additive adjustment. For exact dosage control, the processing liquid is sprayed onto the working rollers 10, 11 by way of a nozzle beam.

The mixed friction conditions in the roller gap 9 are required, since only a defined friction coefficient enables the application of longitudinal tension stress. This longitudinal tension stress acts against the deformation strength and is during the foil rolling the essential factor for the achievement of the deformation resistance. A thickness reduction without this longitudinal tension stress is not possible from a technical point of view.

During cold rolling with a closed roller gap, the reduction resulting from the process and thereby the band thickness in the roller output is controlled by way of the primary parameter of entry tension, since it acts against the deformation resistance of the aluminum foil 4. After achievement of the maximum input tension, the secondary control parameter of roller speed is used to vary the lubricant film thickness (hydrodynamic lubricant input).

During cold rolling, a mixed friction condition is desired which is characterized by the simultaneous occurrence of boundary friction and liquid friction. During liquid friction, which is the hydrodynamic lubrication 14, both surfaces are completely separated from one another. The transferred shear stress depends on the dynamic viscosity of the lubricant and the speed differential between the working roller and the aluminum foil. In contrast, during the boundary friction both surfaces are separated only by a lubricant layer which is only a few molecule layers thick, whereby the viscosity of the lubricant plays only a subordinate role. The ratio between boundary friction and liquid friction over the length of the roller gap depends on the layer thickness of the lubricant pulled in and on the surface roughness of the working roller and the aluminum foil The mechanisms for influencing the lubricant film thickness 13 depend on the hydrodynamic lubricant intake, the input of lubricant into the surface roughness valleys 11*b* as well as the attachment of lubricant particles, see FIG. 2*b*.

The hydrodynamic lubricant intake 14 occurs primarily in the input zone to the roller gap 9. The input zone thereby forms a wedge shaped gap 12, whereby the working roller 11 and the aluminum foil 4 as limiting surfaces during their movement in direction of the wedge tip pull along lubricant 13 in the form of a film, see FIG. 2*a*. The hydrodynamic pressure buildup thereby caused in the rolling oil is dependent on the rolling speed, the viscosity of the lubricant and the geometry of the roller gap. As soon as the yield conditions for the aluminum foils 4 are fulfilled, they are plastically deformed and the layer thickness of the lubricant present at this location is pulled into the roller gap 9.

In the roller gap 9, lubricant is input into the surface depressions, the so-called roughness valleys 11*b*, on the working roller 11 and the aluminum foil 4, see FIG. 4*c*. This process depends, apart from the oil storage volume of the surfaces, also on the orientation of the surface structure.

This mechanism can be used for the directed change of the friction conditions and in the following serves to create a changed surface texture because of the liquid friction generated. This occurs because of the missing contact with the working roller and the thereby missing texturing in rolling direction.

Boundary layers are formed on the surface of the working roller and the aluminum foil, which are carried into the roller gap 9, because of physicosorption and chemisorption of lubricant components, for example surface active additives. This mechanism is influenced by the roller material and the rolled material as well as the chemical composition of the rolling oil 12 and its temperature. Since the temperature and the composition of the rolling oil 12 with respect to the accretion of lubricant components in the process in accordance with the invention are not different from the conventional cold rolling process, this mechanism is not further discussed.

However, it is the combination of the above effects, which by way of directed and partial destruction of the ground-in structure on the working roller makes it possible to bring the lubricant film thickness and the directly associated changes of the tribologic conditions in the roller gap from the mixed friction range in the region of the motif into the hydrodynamic range. This leads to a floating of the working roller and a random texture is generated which differentiates barely measurable in the measured surface roughness, but is optically clearly distinguished because of the reflection properties of the remaining surface regions which through the partial contact with the working roller have a structured surface in rolling direction.

The produced aluminum foil 1 with integrated security features 6 is copied with optical processes in several passes for the purposes of analysis. For the clear illustration of the surface structure, representative foil samples are produced in the format A4. For the measurement of the surface structure of the tools required for the manufacture, epoxy resin imprints of the surface are produced and measured by way of a reflected light microscope and Infinitive Focus.

Figure 5A:
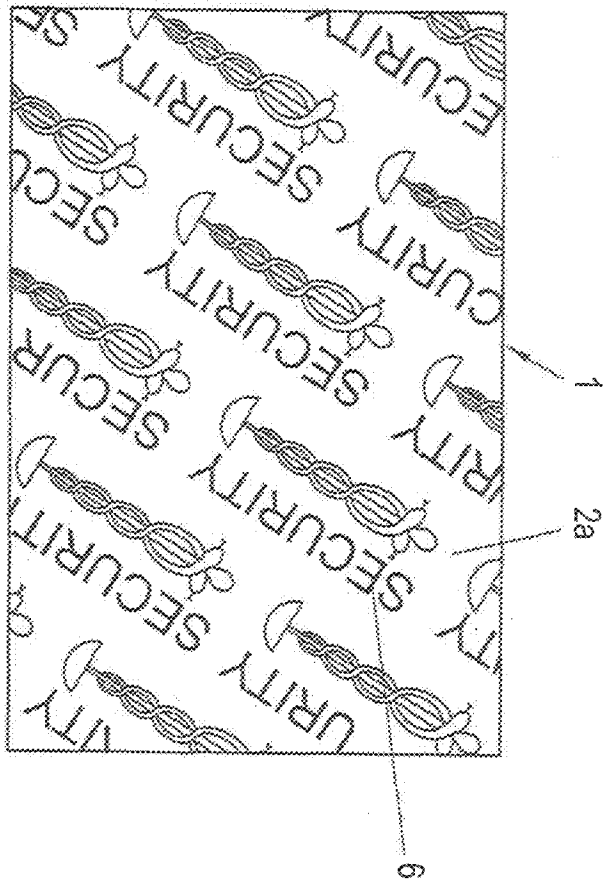
Figure 5B:
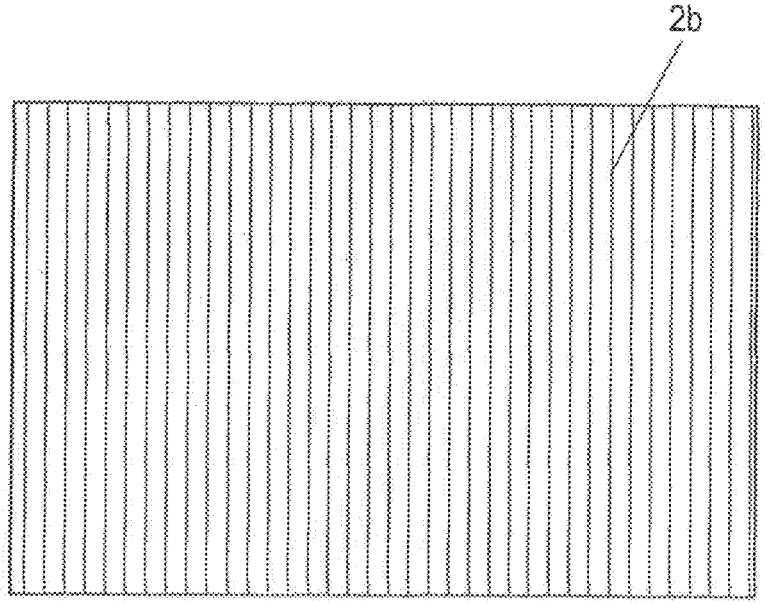

It is now possible with the help of this analytical process to carry out an optical identification for confirmation of the security features 6 produced in accordance with the invention. FIG. 5 shows the illustration of a security feature 6 consisting of the lettering Security in combination with the illustration of a staff of Asclepius customary in the medical industry. Of course, the latter is here illustrated only by way of example and without claim to any exclusionary rights. At any rate, it is important to point out that the outer surface illustrated in FIG. 5*b*, which during the rolling process was directed away from the roller surface, includes no undesired negative print motifs whatsoever of the previously mentioned security feature.

Figure 6A:
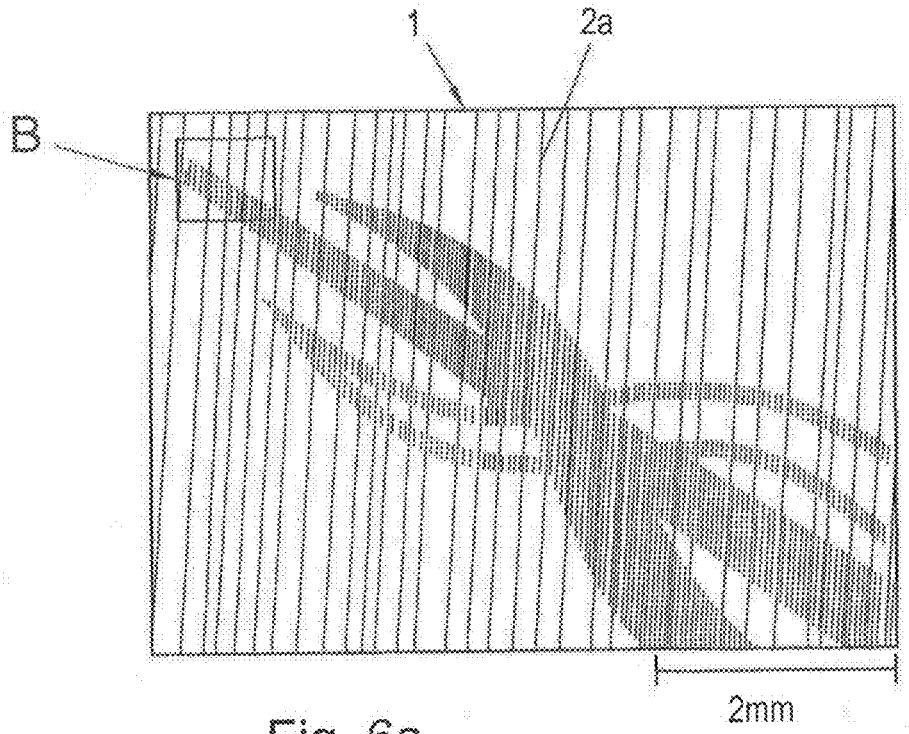
Figure 6B:
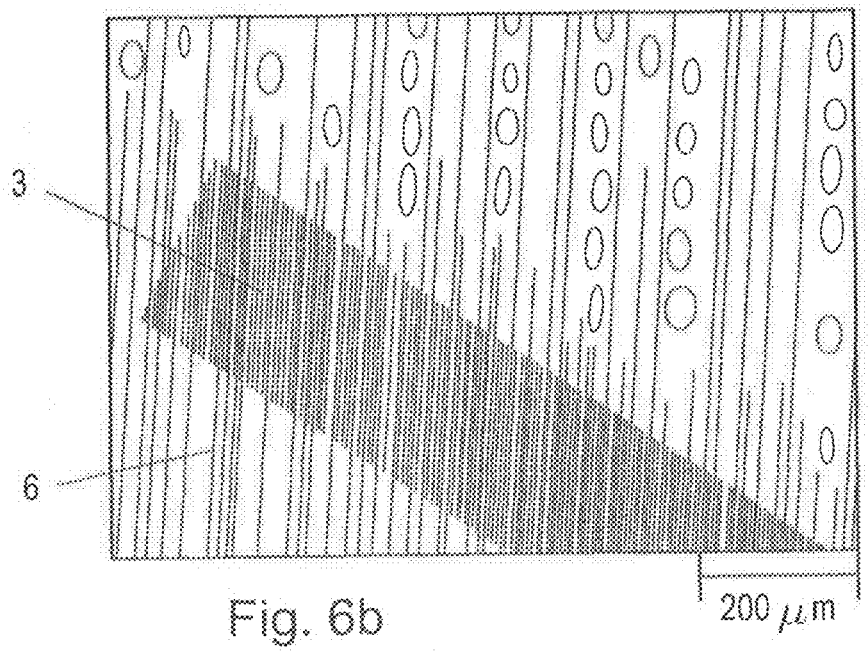

A fantasy illustration of a security feature 6 is shown in FIG. 6 whereby in the section B, see FIG. 6*b*, it is apparent that in the region of the security feature 6 a dull surface is present while in the respectively bordering surface regions the structuring 3 in longitudinal direction continues to be maintained, whereby the surface appears glossy.

Figure 7A:
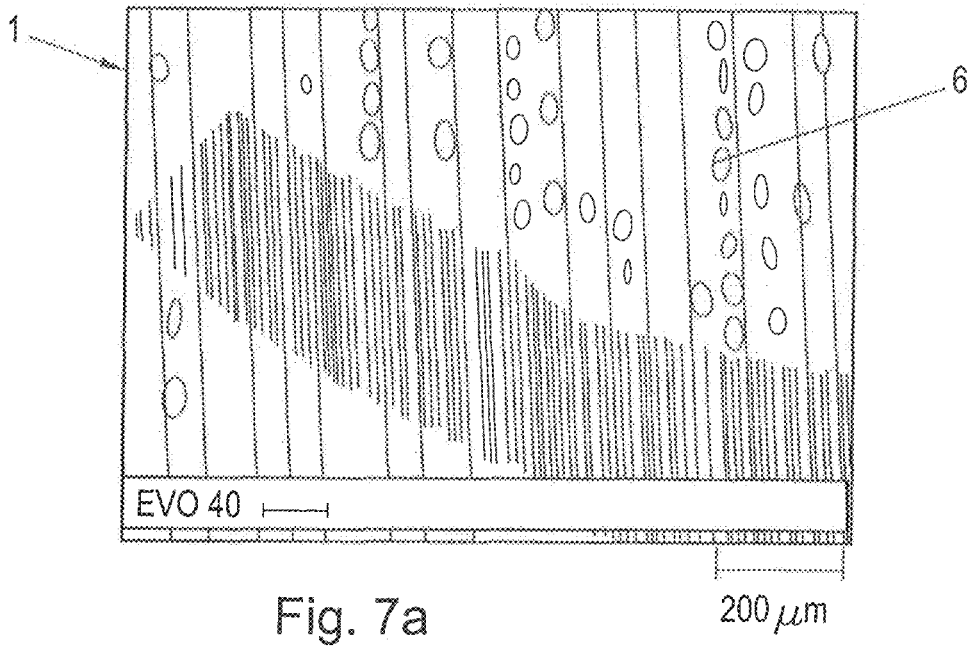
Figure 7B:
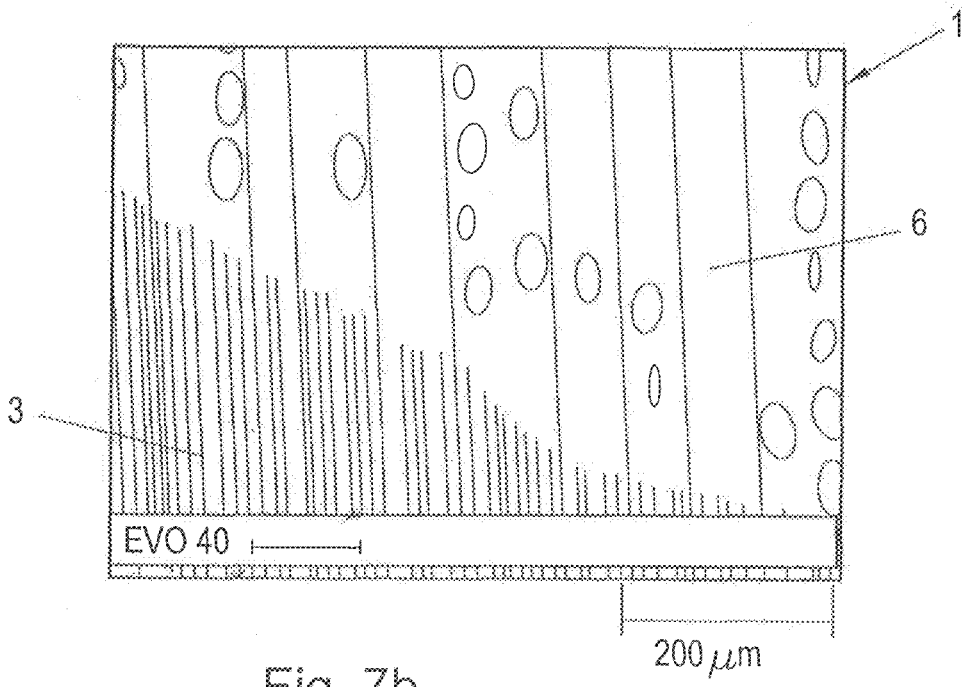
Figure 8B:
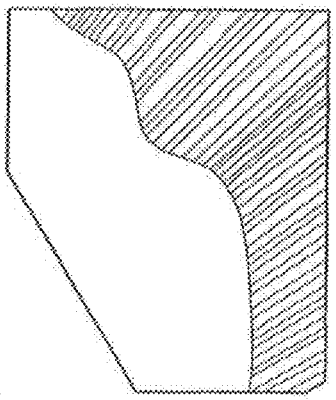
Figure 8C:
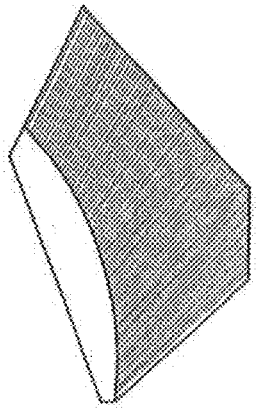
Figure 8D:
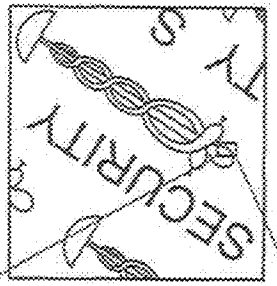
Figure 8A:
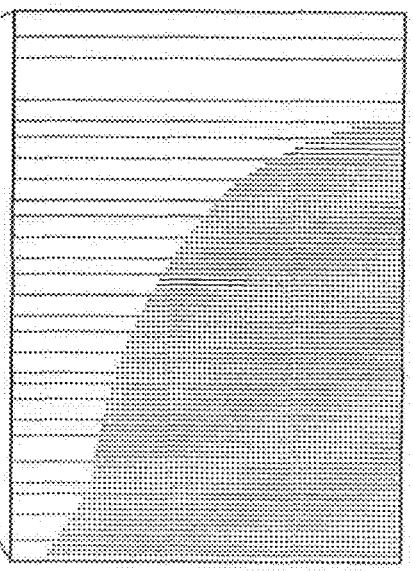

FIG. 7 further shows an image of a security feature 6, taken by way of scanning electron microscopy. In the region of the security feature, the surface is dull, whereby in the bordering surface regions the surface appears glossy. The detailed views according to FIG. 7*a* or 7*b* show that this different effect is caused by the surface being rough in the region of the security feature 6 while it is structured in longitudinal direction in the bordering regions.

This applies analogous to the image shown in FIG. 8 of an aluminum foil 1 manufactured in accordance with the invention with the integrated security feature 6 Security taken according to the Infinitive Focus analysis. From the illustrations of FIGS. 8*a*, 8*b*, 8*c* and 8*d*, it is also apparent that a random texturing is present in the region of the security feature 6, whereas in the bordering regions a directed structuring 13 is present.

In summary, the following essential differentiating features for the exact identification of the process in accordance with the invention are listed:

- Direct application of the security feature 6 and simultaneous with the reduction of the thickness of the aluminum foil 4; thus, no additional processing step is required;
- High operating efficiency due to high speeds during the manufacture of the aluminum foil in accordance with the invention;
- More complicated imitation due to the complexity of the basic process;
- Clear association of the process with the rolling process because of the form and placement of the surface structuring 3;
- No possibility of removal of the security features 6 without destruction of the surface of the aluminum foil;
- No strikethrough of the security feature 6 to the back side of the aluminum foil 1;
- No changes of the physical and/or chemical properties of the aluminum foil 4 such as surface roughness, foldability, stretch, tensile strength and wettability;
- Change of the surface configuration in the range of the fourth order, measurable by way of the average roughness depth Rz;
- No significant change of the arithmetic mean surface roughness index Ra in the region of the security feature 6;
- No shape change in the range of the first order (shape changes such as unevenness or out of roundness), second order (waviness) or third order (grooves).

In the cold rolling used in accordance with the invention, optical features, such as the security feature 6 are applied by the directed application of differing surface textures of the aluminum foils in the range of the fourth order. No significant difference in the surface roughness depth can be determined, but a difference in the type of texturing of grooves and scaling is achieved. A change of the shape of the aluminum foil is not detectable so that a strikethrough to the backside of the foil does also not occur.

The graphic relief type shaping of flexible packaging materials with the help of conventional manufacturing processes and finishing technologies, for example embossing (impression processes) are significantly differentiated from the process in accordance with the invention with respect to the starting material, technology and manufacturing processes as well as the optical or mechanical properties of the end product, since in an impression process the motif to be embossed often strikes though in an undesired manner to the backside of the embossed material.

During the rolling in the course of the process in accordance with the invention, the surface structure of the aluminum foil 4 is changed during the mechanical working, whereby it is made possible to develop on the surface one or more security features 6. An imitation by way of conventional finishing technologies is not possible or is easily identifiable as such. The manufacture and the further processing of the aluminum foil 1 in accordance with the invention with integrated security features 6 is, with respect to the number of manufacturing steps, not distinguished from the processing of conventional, rolled aluminum foils and can therefore easily be implemented in the conventional manufacturing process for pharma products. The produced aluminum foil 1 has a glossy appearance on both outer surfaces 2*a*, 2*b*, so that the security feature 6 is very succinctly distinguished because of its dull appearance.

The invention claimed is:

1. A process for the manufacture of an aluminum foil with integrated security features, comprising:

rolling down a single aluminum foil in several cold rolling passes to a thickness of less than 150 μm, and at the same time on both outer faces of the aluminum foil creating a texturing extending in rolling direction is created, whereby the aluminum foil is fed into a working roller pair in a last cold rolling pass, in which on at least one roller surface the relief surface structure produced by grinding is reduced, depending on contrast and motif, in a range of 10-50% relative to an average depth of surface roughness, for formation of a motif for a security feature which is transferred to an outer face of the aluminum foil facing the roller surface.

2. The process according to claim 1, wherein the last cold rolling pass is carried out with a closed roller gap and a defined mixed friction range is adjusted according to the Striebeck curve by way of the parameters friction coefficient, dynamic viscosity of the rolling oil, rolling speed and rolling pressure and at the same time longitudinal tension is applied to the aluminum foil in the closed roller gap, which tension counteracts a shape change resistance of the aluminum foil.

3. The process according to claim 1, wherein for an aluminum foil of a thickness of ≤80 μm the process is operated with an open roller gap.

4. The process according to claim 1, wherein for the last cold rolling pass the relief surface structuring on the roller surface produced in rolling direction was reduced in an average depth of surface roughness by way of laser beams.

5. The process according to claim 1, wherein the aluminum foil has a tear strength of more than 100 $N/mm^2$.

* * * * *